US010271573B2

(12) United States Patent
Lipowicz

(10) Patent No.: US 10,271,573 B2
(45) Date of Patent: Apr. 30, 2019

(54) TOBACCO WITH AN INCREASED LEVEL OF NATURAL TAR DILUENTS

(75) Inventor: Peter John Lipowicz, Midlothian, VA (US)

(73) Assignee: Philip Morris USA Inc., Richmond, VA (US)

( * ) Notice: Subject to any disclaimer, the term of this patent is extended or adjusted under 35 U.S.C. 154(b) by 456 days.

(21) Appl. No.: 11/444,331

(22) Filed: Jun. 1, 2006

(65) Prior Publication Data

US 2006/0283469 A1 Dec. 21, 2006

Related U.S. Application Data

(60) Provisional application No. 60/685,877, filed on Jun. 1, 2005.

(51) Int. Cl.
*A24B 15/00* (2006.01)
*A24B 15/24* (2006.01)
*A24B 15/30* (2006.01)

(52) U.S. Cl.
CPC ..... *A24B 15/245* (2013.01); *A24B 15/30* (2013.01); *A24B 15/308* (2013.01)

(58) Field of Classification Search
None
See application file for complete search history.

(56) References Cited

U.S. PATENT DOCUMENTS

| | | | | |
|---|---|---|---|---|
| 3,082,125 | A * | 3/1963 | Bavley et al. | 131/276 |
| 3,139,888 | A * | 7/1964 | Grossman | A24B 15/30 131/276 |
| 3,611,635 | A * | 10/1971 | Tanaka et al. | 47/58.1 R |
| 3,654,934 | A * | 4/1972 | Martin | 131/341 |
| 3,965,911 | A | 6/1976 | Anderson et al. | |
| 4,019,521 | A * | 4/1977 | Briskin | A24B 15/165 131/369 |
| 4,056,108 | A * | 11/1977 | Schumacher et al. | 131/278 |
| 4,150,677 | A * | 4/1979 | Osborne, Jr. | A24B 3/12 131/275 |
| 4,256,126 | A * | 3/1981 | Seligman | A24B 15/165 131/353 |
| 4,861,616 | A * | 8/1989 | Spencer | 426/651 |
| 4,967,772 | A | 11/1990 | Waddell et al. | |
| 5,065,776 | A * | 11/1991 | Lawson et al. | 131/365 |
| 5,120,368 | A * | 6/1992 | Houminer et al. | 131/276 |
| 5,249,588 | A | 10/1993 | Brown et al. | |
| 6,153,119 | A * | 11/2000 | Sung | 252/186.25 |
| 6,564,808 | B1 * | 5/2003 | Hempfling et al. | 131/300 |
| 6,591,841 | B1 | 7/2003 | White et al. | |
| 6,755,200 | B1 | 6/2004 | Hempfling et al. | |
| 6,779,531 | B1 | 8/2004 | Biggs et al. | |
| 2002/0062834 | A1 * | 5/2002 | Snaidr et al. | 131/365 |
| 2003/0056801 | A1 | 3/2003 | Krauss et al. | |
| 2004/0154629 | A1 * | 8/2004 | Sampson | 131/202 |
| 2004/0255965 | A1 * | 12/2004 | Perfetti et al. | 131/353 |
| 2005/0000531 | A1 * | 1/2005 | Shi | 131/347 |
| 2005/0039767 | A1 * | 2/2005 | Mua et al. | 131/370 |
| 2005/0241656 | A1 * | 11/2005 | Kennison | 131/274 |
| 2006/0086367 | A1 | 4/2006 | Li et al. | |
| 2006/0162733 | A1 * | 7/2006 | McGrath et al. | 131/298 |
| 2006/0237024 | A1 * | 10/2006 | Reich et al. | 131/270 |

FOREIGN PATENT DOCUMENTS

| | | | | |
|---|---|---|---|---|
| EP | 1252831 | A2 | 10/2002 | |
| GB | 599816 | A | 3/1948 | |
| WO | WO 2005041151 | A2 * | 5/2005 | A24B 3/12 |

OTHER PUBLICATIONS

Philip Morris, "List of Compounds in Tobacco and/or Smoke", Legacy Tobacco Documents Library, Jul. 9, 2002.*

Colin L. Browne, "The Design of Cigarettes", Sep. 1990, Hoechst Celanese, Third Edition.*

Matsukura et al. "Composition of Semivolatiles from Roasted Tobacco", Agricultural and Biological Chemistry, 1983, 47:10, p. 2281-2285.*

International Search Report dated Jan. 2, 2007 for PCT/IB2006/002903.

Ei'ichiro Fukusaki et al., "*Biosynthetic Pathway for the C45 Polyprenol, Solanesol, in Tobacco*," Biosci. Biotechnol. Biochem, 68 (9), 2004, pp. 1988-1990.

Gusui Wu et al., "*Activation of Host Defense Mechanisms by Elevated Production of $H_2O_2$ in Transgenic Plants*," Plant Physiol. 1997, vol. 115, pp. 427-435.

Francois Bernier et al., "*Germins and Germin-Like Proteins: Plant Do-All Proteins. But What Do They Do Exactly?*," Plant Physiol. Biochem., 2001, vol. 39, pp. 545-554.

Ann McNeill, Ph.D., et al., "*Review of the Implementation of the Tobacco Product Regulation Directive 2001/37/EC*," Mar. 2004, pp. 1-74.

O.T. Chortyk et al., "*Chromatographic determinatin of hydrocarbon waxes in tobacco leaf and smoke*," 1975, Beitr. Tabakforsch., 8, pp. 204-210.

* cited by examiner

*Primary Examiner* — Cynthia Szewczyk
(74) *Attorney, Agent, or Firm* — Buchanan Ingersoll & Rooney LLP

(57) ABSTRACT

Disclosed are methods and compositions for preparing tobacco such that components of tobacco tar are reduced, while maintaining the total tar delivery of a composition or device containing tobacco treated with one or more natural tar diluents. Artificial tar diluents can also be used in combination with one more natural tar diluents. The tobacco compositions have decreased levels of tobacco specific nitrosamines and/or other components found in tar when the composition is smoked, while maintaining the total tar delivery of the smoking article, such as a cigarette, when using a tar diluent at a level sufficient to achieve desired taste qualities.

14 Claims, No Drawings

TOBACCO WITH AN INCREASED LEVEL OF NATURAL TAR DILUENTS

CROSS-REFERENCE TO RELATED APPLICATION

This application claims priority under 35 U.S.C. § 119 to U.S. Provisional Application No. 60/685,877 entitled TOBACCO WITH AN INCREASED LEVEL OF NATURAL TAR DILUENTS, filed Jun. 1, 2005, the entire content of which is hereby incorporated by reference.

BACKGROUND

Tobacco tar is derived from smoking a tobacco containing composition. For example, cigarette smoke contains tiny particles, which can be collected on a filter ("Cambridge") pad in accordance to a laboratory procedure. Tar is usually described as the particulate matter collected in this way, after water and nicotine have been removed. Tar is composed of numerous known and unknown components. Certain components in tar, such as tobacco specific nitrosamines ("TSNAs"), have been targeted for removal or reduction.

Therefore, notwithstanding what has previously been reported in the literature, there exists a need for improved methods of maintaining and/or enhancing flavor and taste of smoked tobacco compositions, while decreasing the levels of certain components in the tar, such as TSNAs.

SUMMARY

The compositions, methods, and devices described herein serve to maintain and/or enhance flavor and/or taste of a tobacco composition for use in but not limited to cigarettes, cigars, and pipe tobaccos. The methods and devices described herein are directed to increasing one or more natural tar diluents in the tobacco containing composition, wherein the tar diluent is naturally found in tar. The compositions thus contain one or more of these natural tar diluents. The natural tar diluents can be an extracted compound, synthetically generated, or over-expressed in a tobacco plant as a result of genetic engineering, external manipulation, or chemical treatment of the tobacco plant. Increasing the levels of the natural diluents disclosed herein, while maintaining the total tar delivery of the cigarette or other tobacco containing article by changing the cigarette design for example, results in a tar with a lower level of undesired tar components.

One aspect contemplates a tobacco comprising composition or a smoking article with a tobacco comprising composition, wherein the composition comprises a tar diluent effective amount of a tar diluent. The tar diluent can be one that is a natural component of tobacco tar, or can be an artificial diluent, which is a diluent not naturally present in tobacco tar. The diluents can also be combinations of artificial tar diluents and natural tar diluents. Preferably, the composition comprises one or more natural tar diluents.

One aspect contemplates that the natural tar diluent be added to the tobacco containing composition and admixed with the tobacco containing composition. Another aspect contemplates that the natural tar diluent be present in the tobacco plant due to over-expression of a gene which synthesizes the tar diluent or precursor to a tar diluent.

Another aspect contemplates that the tar diluent be present in an amount ranging from about 5 weight percent to about 75 weight percent of total tobacco tar in the tobacco comprising composition.

Examples of natural tar diluents contemplated include but are not limited to solanesol; neophytadiene; 3-methyl-1-pentanol; 1-nonadecanol; 2-ethyl-1-hexanol; bomeol; phenethylalcohol; 4-(4-tolyl)-1-butanol; glycerol; erythritol; 1,3,6-hexantriol; levoglucosan; a duvene alcohol; p-dimethoxybenzene; 3-methylanisole; eugenol methyl ether; 4-methylbenzaldehyde; 2,4-dimethylbenzaldehyde; 2,4-dimethyl-3-pentanone; 2-heptanone; 3-hexanone; 2-nonanone; 2,6-heptanedione; 5-isopropyl-8-methylnona-6,8-dien-2-one; 5-methyl-2-(1-methylethyl)-cyclohexanone; cycloheptanone; 1-phenyl-1-pentanone; 2,3-dimethyl-4-ethylacetophenone; 3,4-dimethoxyl-acetophenone; 4-phenylbutanone; 3,4-dimethylacetophenone; 3-pyridyl methyl ketone; 3-pyridyl ethyl ketone; 3-pyridyl propyl ketone; heptanoic acid; octanoic acid; 6-heptenoic acid; cyclohexanecarboxylic acid; 16-methyloctadecanoic acid; levulinic acid; 4-oxohexanoic acid; 4-t-butylbenzoic acid; 2,3-dimethylbenzoic acid; 2-ethylbenzoic acid; 3-ethylbenzoic acid; 4-ethylbenzoic acid; 2-phenylpropionic acid; 3-furoic acid; nicotinic acid; 3-methylglutaric acid; an amino acid; a hydroxy acids; methyl 3-ketopentanoate; 3-oxobutyl acetate; ethyl hexanoate; ethyl isovalerate; ethyl 3-methylvalerate; glycerin triacetate; butyl octadecanoate; methylbenzoate; benzyl acetate; 4-methoxybenzylacetate; 4-methylvaleramide; phenylacetamide; 3-phenylpropionamide; nicotinamide; 6-ethyl-3-pyridine-carboxamide; 2-isobutylpyridine; 3-butylpyridine; 3-acetyl-5-methylpyridine; (R)-cotinine; nicotyrene; (R)-N'-alkanoyinornicotine; (R)-N-methylanabasine; (S)-N-valerylanabasine; (R)-N'-ethylnornicotine; (R)-N'-carbomethoxyanabasine; (R)-N'-carbomethoxynornicotine; 2-furylpyrazine; 2,6-dimethyl-5-ethylpyrazine; pentylpyrazine; a butenylpyrazine; 4-(3-methyl-2-pyrazinyl)-butyl alcohol; 2-(6-methyl-2-pyrazinyl)-ethyl alcohol; 2-methyl-3-hydroxyethyl pyrazine; 4-ethyl-2-isopropylimidazole; 2,5-dimethyl-4-isopropylimadazole; 4-acetylthiazole; 2-methyldotriacontane, 2-methylhentriacontane; 2-methylheptacosane; 2-methylhexacosane; s-methylnonacosane; 2-methyloctacosane; 2-methyltetratriacontane; 2-methyltriacontane; 2-methyltritriacontane; 3-methyldotriacontane; 3-methylhentriacontane; 3-methylheptacosane; 3-methyloctacosane; 3-3-methyltetratriacontane; 3-methyltriacontane; 3-methyltritriacontane; docosane; dotriacontane; eicosane; heneicosane; hentriacontane; heptacosane; hexacosane; nonacosane; octacosane; pentacosane; pentatriacontane; squalene; tetracosane; tetratriacontane; triacontane; triacosane; and tritriacontane. Preferred natural tar diluents include but are not limited to solanesol and/or neophytadiene. These preferred natural tar diluents can be combined with one or more artificial and/or natural tar diluents. An example of an artificial tar diluent is glycerin. Glycerin, or another tar diluent, can be present in the tobacco comprising composition in an amount of about 5 to about 10 weight percent of total tobacco tar of the tobacco comprising composition.

Another aspect contemplates that the tobacco in the tobacco comprising composition has reduced TSNA level. The TSNA levels can be reduced by mechanical manipulation of the tobacco plant, chemical treatment of the tobacco plant or parts thereof, and/or a genetically engineered tobacco plant with reduced TSNAs, or a combination of these methods. Tobacco with reduced TSNAs and other tar components would be then contemplated for use in any tobacco containing smoking article, for example a cigarette.

Another aspect provides for a method of decreasing one or more TSNAs components of tar in a smoking article comprising:

(1) administering to a tobacco material a natural tar diluent in a tar diluent effective amount such that one or more components of tar is decreased while maintaining total tar delivery in the smoking article; and (2) placing the tobacco material with the natural tar diluent in a smoking article.

An example of a reduced tar component is a TSNA. TSNAs include N-nitrosoketone ("NNK") and nitrosonomicotine ("NNN"), amongst others. The method can also include using tobacco material wherein the TSNAs have been reduced by mechanical treatment to have reduced TSNAs, tobacco that has been chemically treated to have reduced TSNAs; tobacco genetically engineered to have reduced TSNA, in addition to the use of tar diluents.

DETAILED DESCRIPTION

Methods, compositions, and devices for increasing tar yield of a tobacco containing article, such as a cigarette, are described, wherein such articles would have a decreased yield of unwanted tar components.

Various natural tar diluents naturally exist in both tobacco and tobacco smoke. For examples, solanesol and neophytadiene exist in tobacco smoke tar. In one aspect, it is contemplated that a tobacco comprising composition would comprise an additional amount of either or both of these components in an amount sufficient for the compound(s) to serve as natural tar diluents. Another aspect contemplates other natural tar diluents alone or in combination to be used in a tobacco composition to dilute one or more components of tar while maintaining total tar delivery.

Definitions and Acronyms

It must be noted that as used herein, the singular forms "a", "an", and "the" include plural referents unless the context clearly dictates otherwise. Thus, for example, reference to "a smoking article" includes a plurality of smoking articles, and reference to "the smoking article" includes reference to one or more types of smoking articles.

Unless defined otherwise, all technical and scientific terms used herein have the same meaning as commonly understood by one of ordinary skill in the art. The following terms are defined below.

"Tobacco materials" is meant to include materials derived from the tobacco plant. These can include leaves, stems, stalks, and roots of the tobacco plant as well as fines, dust, and scrap of tobacco plants. The tobacco material may be subjected to various means to reduce the size of the material, such as but not limited to grinding to produce a fine ground or powder form of tobacco. The tobacco material can be used in various tobacco containing compositions or devices that can be smoked, such as but not limited to, cigarettes, cigars, or smoking tobacco. Tobaccos may also include transgenic tobaccos or other genetically engineered varieties of tobacco. Tobaccos may further include those that have been chemically or mechanically manipulated such that they have an altered level of TSNAs or tar components.

"Tobaccos" include, but are not limited to, Burley, Bright, Flue-cured, Virginia, Oriental, and Turkish as well as rare or specialty tobaccos, and blends thereof. The tobacco material may also include unaged, uncured, mature, or immature tobaccos, or combinations thereof. Tobaccos may also include genetically engineered tobaccos, chemically treated tobaccos, and/or mechanically treated tobaccos. Thus, tobaccos can include any combination or blend as well as tobacco from any source for use in a smoking article.

"Smoking article" is meant to include cigarettes, cigars, electrically heated smoking systems, and pipes.

"Tobacco containing article" is meant to include all smoking articles, as well as pouch tobaccos.

"Natural tar diluent" is meant to include any compound that is a natural component of tobacco or tobacco smoke, and which dilutes tar such that one or more other components of tar are diluted. The natural tar diluent when added to tobacco would be a component such that upon smoking said tobacco composition containing said natural tar diluent, the amount of tar present is increased without a corresponding increase of one or more TSNAs (e.g., NNK and NNN) and other tar components. The natural tar diluent may also maintain, or preferably enhance, the taste or flavor of the tobacco composition containing the diluent(s) over compositions which do not contain the one or more tar diluents. An example of a tar diluent that is not naturally found in either tobacco or tobacco smoke is glycerin. Natural tar diluents are contemplated to include paraffins, waxes, and saturated hydrocarbons with 20 or more carbon atoms that are found in tar. Also contemplated are combinations of natural tar diluents with artificial tar diluents to be used in tobacco containing compositions as a means of reducing TSNAs and other components of tar. A natural tar diluent can be one manufactured synthetically or one that is derived from tobacco tar ("tobacco-derived tar diluent"). Thus, by "tobacco-derived tar diluent" or "TDTDs" is meant a compound or composition that is naturally found and extracted from tobacco tar. However, the natural tar diluent can be extracted, synthetically produced, or produced by any other available means. Natural tar diluents can include but are not limited to: phytol; solanesol; neophytadiene; 3-methyl-1-pentanol; 1-nonadecanol; 2-ethyl-1-hexanol; bomeol; phenethylalcohol; 4-(4-tolyl)-1-butanol; glycerol; erythritol; 1,3,6-hexantriol; levoglucosan; a duvene alcohol; p-dimethoxybenzene; 3-methylanisole; eugenol methyl ether; 4-methylbenzaldehyde; 2,4-dimethylbenzaldehyde; 2,4-dimethyl-3-pentanone; 2-heptanone; 3-hexanone; 2-nonanone; 2,6-heptanedione; 5-isopropyl-8-methylnona-6,8-dien-2-one (also known as solanone); 5-methyl-2-(1-methylethyl)-cyclohexanone (also known as menthone); cycloheptanone; 1-phenyl-1-pentanone; 2,3-dimethyl-4-ethylacetophenone; 3,4-dimethoxyl-acetophenone; 4-phenylbutanone; 3,4-dimethylacetophenone; 3-pyridyl methyl ketone; 3-pyridyl ethyl ketone; 3-pyridyl propyl ketone; heptanoic acid; octanoic acid; 6-heptenoic acid; cyclohexanecarboxylic acid; 16-methyloctadecanoic acid; levulinic acid; 4-oxohexanoic acid; 4-t-butylbenzoic acid; 2,3-dimethylbenzoic acid; 2-ethylbenzoic acid; 3-ethylbenzoic acid; 4-ethylbenzoic acid; 2-phenylpropionic acid; 3-furoic acid; nicotinic acid; 3-methylglutaric acid; amino acids (e.g., proline; ornithine); hydroxy acids (e.g., salicylic acid, m-hydroxyhydrocinnamic acid); methyl 3-ketopentanoate (methyl levulinate); 3-oxobutyl acetate; ethyl hexanoate; ethyl isovalerate; ethyl 3-methylvalerate; glycerin triacetate; butyl octadecanoate; methylbenzoate; benzyl acetate; 4-methoxybenzylacetate; 4-methylvaleramide; phenylacetamide; 3-phenylpropionamide; nicotinamide; 6-ethyl-3-pyridine-carboxamide; 2-isobutylpyridine; 3-butylpyridine; 3-acetyl-5-methylpyridine; (R)-cotinine; nicotyrene; (R)-N'-alkanoyinornicotine; (R)-N-methylanabasine; (S)-N-valerylanabasine; (R)-N'-ethylnornicotine; (R)-N'-carbomethoxyanabasine; (R)-N'-carbomethoxynornicotine; 2-furylpyrazine; 2,6-dimethyl-5-ethylpyrazine; pentylpyrazine; a butenylpyrazine; 4-(3-methyl-2-pyrazinyl)-butyl alcohol; 2-(6-methyl-2-pyrazinyl)-ethyl alcohol; 2-methyl-3-hydroxyethyl pyrazine; 4-ethyl-2-isopropylimidazole;

2,5-dimethyl-4-isopropylimadazole; and 4-acetylthiazole. Natural tar diluents also include stereoisomers, salts, acids, or base forms of any of the natural tar diluents discussed herein. A list of saturated hydrocarbons that are natural tar diluents, and can be used in the method and compositions described herein, include but are not limited to the following:

| CAS No. | Compound |
|---|---|
| 1720-11-2 | 2-METHYLDOTRIACONTANE |
| 1720-12-3 | 2-METHYLHENTRIACONTANE |
| 1561-00-8 | 2-METHYLHEPTACOSANE |
| 1561-02-0 | 2-METHYLHEXACOSANE |
| 1560-75-4 | 2-METHYLNONACOSANE |
| 1560-98-1 | 2-METHYLOCTACOSANE |
| 14167-65-8 | 2-METHYLTETRATRIACONTANE |
| 1560-72-1 | 2-METHYLTRIACONTANE |
| 66214-27-5 | 2-METHYLTRITRIACONTANE |
| 20129-49-1 | 3-METHYLDOTRIACONTANE |
| 4981-99-1 | 3-METHYLHENTRIACONTANE |
| 14167-66-9 | 3-METHYLHEPTACOSANE |
| 14167-67-0 | 3-METHYLNONACOSANE |
| 65820-58-8 | 3-METHYLOCTACOSANE |
| 66309-88-4 | 3-METHYLTETRATRIACONTANE |
| 72227-01-1 | 3-METHYLTRIACONTANE |
| 14167-69-2 | 3-METHYLTRITRIACONTANE |
| 629-97-0 | DOCOSANE |
| 544-85-4 | DOTRIACONTANE |
| 112-95-8 | EICOSANE |
| 629-94-7 | HENEICOSANE |
| 630-04-6 | HENTRIACONTANE |
| 593-49-7 | HEPTACOSANE |
| 630-01-3 | HEXACOSANE |
| 504-96-1 | NEOPHYTADIENE |
| 630-03-5 | NONACOSANE |
| 630-02-4 | OCTACOSANE |
| 629-99-2 | PENTACOSANE |
| 630-07-9 | PENTATRIACONTANE |
| 150-86-7 | PHYTOL |
| 13190-97-1 | SOLANESOL |
| 111-02-4 | SQUALENE |
| 646-31-1 | TETRACOSANE |
| 14167-59-0 | TETRATRIACONTANE |
| 638-68-6 | TRIACONTANE |
| 638-67-5 | TRICOSANE |
| 630-05-7 | TRITRIACONTANE |

"Tar diluent effective amount" is meant to include an amount of a natural tar diluent sufficient to be detected using such assays as a tar yield assay, a chemical assay detecting one or more components of tar, and/or a biological assay. Thus, for example, a diluent effective amount is an amount of one or more natural tar diluents of about 5.0% to about 75.0% (or any whole integer or 0.1 value in between) of the total tar weight of the tobacco containing article. Total tar weight is the weight of the tar present in the tobacco that is present in the tobacco containing article. For example, a natural tar diluent effective amount of solanesol and/or neophytadiene can be from about 1 milligram per smoking article (e.g., cigarette) to about 150 mg in light of the amount of tobacco that is generally present in an average cigarette. Alternatively, a smoking article such as a cigarette can comprise about 5 mg to about 150 mg of solanesol and/or neophytadiene. It is also contemplated that the effective amount of the natural tar diluent can comprise more than one natural tar diluent. For example, the effective amount may comprise a combination of solanesol and neophytadiene (or any other combination or cocktail of natural tar diluents discussed herein), in equal or in unequal amounts relative to each other. It is further contemplated that the natural tar diluents can be combined with tar diluents not naturally found in tar. Tar is measured by the Standard International Standards Organization (ISO) and modified ISO or intense puffing conditions or similar methods. Tar can be calculated from the measurement of the total particulate matter minus the nicotine minus the water. The ISO/FTC (FTC=Federal Trade Commission) standard conditions and a modified smoke condition is summarized in the following table:

| | Standard ISO | Modified ISO (used for the 1998 & 1999 reporting years) | Modified ISO (Used for the 2000 and beyond reporting years) |
|---|---|---|---|
| Puff volume | 35 mL | 56 mL | 55 mL |
| Puff Interval | 60 seconds | 26 seconds | 30 seconds |
| Puff Duration | 2 seconds | 2 seconds | 2 seconds |
| Ventilation Holes | Not blocked | Fully blocked | Fully blocked |

The data in the above table has been set forth and described by McNeill, A., et al., *Review of the implementation of the Tobacco Product Regulation Directive* 2001/37/*EC*, Commissioned by ASH London (March 2004).

"Solanesol" is meant to include the compound collectively known as nonaisoprenol; betulaprenol 9; betulaneonaprenol; and 2,6,10,14,18,22,26,30,34-hexatriacontanonaen-1-ol,3,7,11,15,19,23,27,31,35-nor.

"Neophytadiene" is meant to include the compound collectively known as NISTR70585 and 3,7,11,15-tetramethylhexadeca-1,3-diene.

NNK is meant to include a TSNA which includes 4-(methylnitrosamino)-1-(3-pyridyl)-1-butanone. Another TSNA is NNN.

Method of Applying Natural Tar Diluents to Tobacco Containing Compositions

An aspect contemplates applying one or more of the natural tar diluents to tobacco or to a composition comprising tobacco. The method of applying the natural tar diluent can occur at any time during tobacco processing. For example, the natural tar diluent can be added to tobacco prior to shredding for preparation of a cigarette, or it can be added after the tobacco has been shredded. For other smoking articles, the tobacco can be treated after curing while the tobacco is in the form of whole leaf, cured tobacco. Alternatively, the natural tar diluent may be added prior to or during tobacco curing.

The natural tar diluents can be added to the tobacco in the form of powders or other solid form, as well as in liquids or gels or in combination of forms at the same or different points of tobacco processing. The natural tar diluents can also be added with other reagents commonly used to make tobacco containing smoking articles or tobacco containing compositions. The natural tar diluents can be administered via spraying, admixing, or soaking of the tobacco. The tobacco can be a whole leaf form or shred form or any other form of tobacco used to prepare a smoking article, or pouch tobacco.

For example, the tar diluents can be sprayed onto the tobacco or tobacco-containing compositions at one time or at multiple stages during processing of the tobacco for purpose of making a smoking article, or pouch tobacco. For purposes of spraying, the tar diluent can be admixed in an aqueous solution and sprayed on the tobacco in a tar diluent effective amount. Alternatively, the natural tar diluent can be admixed in a volatile liquid, such as methanol or ethanol, and sprayed onto the tobacco, such that the alcohol evaporates leaving the natural tar diluent on the tobacco. Alternatively, tobacco leaves can be washed or soaked in solutions comprising the natural tar diluents, such that a tar diluent effective amount remains on the leaves after the leaves have dried.

The admixture of one or more natural tar diluents and tobacco can be further admixed with other reagents. Such other reagents may include but are not limited to fillers (calcium carbonate, magnesium carbonate), humectants (ethylene glycol, polyethylene glycol), film forming agents (methyl cellulose, sodium carboxymethyl cellulose, pectins, gums), glow controlling catalysts (potassium citrate, calcium carbonate, magnesium carbonate), cellulose comprising materials (e.g., microcrystalline cellulose, "MCC"), and ash cohesion agents (citric acid, sodium hydrogen phosphate, other tobacco extracts).

The tobacco admixture may further include binders. Suitable binders include but are not limited to alginates, such as sodium alginate, celluloses, modified celluloses (hydroxypropyl cellulose, carboxymethyl cellulose, and modified forms of MCC), starches, modified starches, and natural gums.

The tobacco admixture may further include flavorings. Suitable flavorings include but are not limited to citrus oils, menthol, mint oils, and other vegetable and fruit derived flavors and flavoring precursors. Typical water-soluble and oil-soluble flavors include lavender, cinnamon, cardamom, apium graveolens, fenugreek, cascarilla, sandalwood, bergamot, geranium, honey essence, rose oil, vanilla, lemon oil, orange oil, mint oils, cassia, caraway, cognac, jasmine, chamomile, menthol, cassia, ylang-ylang, sage, spearmint, ginger, coriander, and coffee. Each of the water-soluble or oil-soluble flavors can be used singly or mixed with others. If desired, diluent agents can be added to the natural polysaccharide or a derivative thereof, and the above flavors. Diluent agents which can be used for this purpose include powdered starch, such as but not limited to corn starch and potato starch, rice powder, calcium activated carbonate, diatomaceous earth, talc, acetate powder, and pulp flock. Flavorants can also be in the form of a solid matrix (liquid flavorants spray dried with a starch). Flavorants can also be in the form of solids, liquids, or gels.

More specifically, the tobacco admixture may further include inorganic fillers. Suitable inorganic fillers include, but are not limited to, calcium carbonate, perlite, vermiculite, diatomaceous earth, colloidal silica, magnesium oxide, magnesium oxide, magnesium sulfate, magnesium carbonate, or other low density inorganic filler materials.

Smoking materials may also comprise one or more mechanical stabilizers, such as but not limited to cocoa, sugar, and fibers such as paper fibers. Expansion medium, such as starch, pullulan or other polysaccharides or foaming agents, for example, and high fat or high oil materials, such as cocoa butter or vegetable oils, such as olive oil and corn oil, may also be used.

A smoking article may further comprise an aerosol generator such as a polyhydric alcohol, an ester, a high boiling point hydrocarbon, glycerol, propylene glycol, triethylene glycol, methylene glycol, methyl citrate, triacetin or diacetin, either alone or in combination.

An example of a smoking material composition can comprise an aerosol generator, a binder, an inorganic filler of up to about 20% by weight, and not more than 1-20% by weight of binder, and from about 5% to about 75% of a natural tar diluent by weight of the tar in the smoking material composition. The smoking material may further contain tar diluents that are not natural components of tar in combination with the natural tar diluents. The natural tar diluents can be admixed with one or more of the compounds or compositions discussed above, or may be separate from the other smoking article and/or tobacco material components.

Agronomic Methods for Increasing Natural Tar Diluents in Tobacco Plants

Another aspect contemplates methods of mechanically, chemically, and/or genetically engineering or manipulating tobacco plants and species of *Nicotiana* to over express a natural tar diluent or precursor of a natural tar diluent. For example, transgenic *Nicotiana* species produced either by virally or non-virally transfected mechanisms to express a gene which results in over expression of a natural tar diluent or a precursor thereof are contemplated for use in obtaining cured and/or processed tobacco that contains one or more over expressed natural tar diluents or precursors thereof. The precursor of the natural tar diluent is one that becomes a tar diluent upon smoking the tobacco by the end user.

Genetically engineered forms of tobacco can further have additional natural tar diluents added via spraying, soaking, or washing of the tobacco leaves or other mechanisms of administering the natural tar diluents to the genetically engineered tobacco product.

It is further contemplated that the genetically engineered tobacco plants can over express more than one natural tar diluent or tar diluent precursor. Additionally, genetically engineered tobacco plants may further be knockout plants incapable of synthesizing one or more components in tar. Examples of components that can be reduced in the tobacco plant include but are not limited to TSNAs.

Another aspect contemplates mechanical or external manipulation of the tobacco plant during growth and prior to harvest which would result in reduced amounts of certain tar components and/or increased amounts of natural tar diluents. For example, the tobacco plant may be subjected to treatment such that it has a decreased amount of TSNAs. Mechanical treatments for reducing TSNAs by increasing antioxidant levels can be performed for example as discussed in commonly assigned U.S. Pat. Nos. 6,755,200 and 6,564,808; in commonly-assigned U.S. patent application Ser. No. 10/235,636 (published as U.S. Pre-Grant Publication No. 2003/0056801, and commonly-assigned U.S. patent application Ser. No. 11/300,590 which claims priority to U.S. Provisional Application No. 60/638,170), which are herein incorporated by reference in their entirety for all purposes. Chemical mechanisms and genetically engineered mechanisms for increasing antioxidant levels in order to reduce TSNAs are described for example in U.S. Pat. Nos. 6,775,200; 6,564,808 would be contemplated for use with any *Nicotiana* species and/or genetically engineered variant or combination thereof.

For the genetically engineered variants that have reduced TSNAs, preferred plants would include those that are genetically engineered to interfere with the nitrosation of secondary alkaloids, and thereby reduce the formation of TSNAs. A means of interfering with nitrosation is via antioxidant production. Antioxidants can be produced in a plant for example as a result of increased active oxygen species.

Active oxygen species include, for example, peroxides such as hydrogen peroxide ($H_2O_2$), $O_2^-$, and $OH^+$. In preferred embodiments, the polypeptide that catalyzes production of active oxygen species is an oxidase, for example an oxidase selected from among oxalate oxidase and glucose oxidase. Other polypeptides, including proteins, which catalyze the production of active oxygen species are known to those skilled in the art, for example, acyl CoA oxidase, aspartate oxidase, choline oxidase, copper amine oxidase, eosinophil peroxidase, flavin oxidase, galactose oxidase, glycolate oxidase, monoamine oxidase, polyamine oxidase, NADPH oxidase, xanthine oxidase, and the like.

Preferred oxidase enzymes include germin-like oxalate oxidase and glucose oxidase. Oxolate oxidase ("OxO") catalyzes the degradation of oxalic acid into $H_2O_2$ and $CO_2$. The coding sequence of a germin-like OxO gene was isolated and genetically engineered for constitutive expression in plants (see Bernier, F., et al., 2001, *Germins and germin-like proteins: Plant do-all proteins. But what do they do exactly*?, Plant Physiology and Biochemistry 39:545-554). Wu et al., (Plant Physiology, 115:427-435, 1997) created a transgenic potato plant expressing a fungal glucose oxidase gene that demonstrates some resistance to pathogens. The level of accumulation of salicylic acid in the leaves of the potato plant increased and the production of mRNA's of defense-related genes encoding anionic peroxidase and chitins were also induced. Constitutively elevated levels of $H_2O_2$ appear to activate an array of host defense mechanisms including the production of antioxidants.

As used herein, heterologous nucleotide sequence means a nucleotide sequence, such as a gene sequence or the coding sequence of a gene, which is derived from a different organism than the host organism in which it has been placed and/or a nucleotide sequence, which may include a sequence native to the host organism, that has been cloned from its native location and manipulated so as to be coupled with sequence with which it is not naturally coupled. For example a sequence encoding a native protein may be coupled to a non-native promoter sequence, a native promoter sequence can be coupled to a non-native protein, or native protein and promoter sequences that are naturally found in different genes may be coupled and reintroduced into a host organism. A transgenic plant is a plant having a heterologous nucleotide sequence in its cells. Reliable methods for cloning a heterologous nucleotide sequence and introducing the heterologous gene into plant cells so as to produce a transgenic plant are well known to the skilled practitioner.

Regulatory sequences include those sequences necessary for transcription and/or translation of a coding sequence. For example, regulatory sequences of a gene generally include a promoter sequence. Promoters can be constitutively active, providing for continuous expression of a gene, or may be inducible, providing for expression of a gene in response to an inducer stimulus. A promoter may also comprise elements that provide for a level of constitutive expression coupled to elements that provide a higher level of expression in response to one or more inducers.

EXAMPLE

Glycerin as a Tar Diluent in a Cigarette

Cigarettes were prepared and tested at glycerin levels of 4% and 20% by weight in the filler. The glycerin content of the total particulate matter (TPC) increased from 7% to 31%. The concentration of TPM of catechol, hydroquinone, NNN, NNK, BaA (benzo-[a]-anthracene), and BaP (benzo-[a]-pyrene) decreased by 46, 40, 49, 42, and 36 percent, respectively. The specific cytotoxicity and specific mutagenicity decreased by 43 and 37 percent respectively. The results in the Table below demonstrate a diluent effect of glycerin on the prepared cigarette. Thus, if another diluent or combination of diluents were substituted for glycerin, a reduction in the cytoxicity and mutagenicity due to the various compounds would similarly be expected.

| PER TPM | | Whistle-Through Filter 03.LP.408 | Whistle-Through Filter 0.3.LP.411 | Percent Reduction |
|---|---|---|---|---|
| FILLER | | | | |
| Filler Glycerin | % (DWB) | 3.7 | 19.6 | |
| SMOKE | | | | |
| Total "Tar" | mg/mg TPM | 0.72 | 0.72 | 1 |
| Glycerin | mg/mg TPM | 0.07 | 0.31 | −321 |
| Nicotine | mg/mg TPM | 0.05 | 0.03 | 43 |
| Catechol | μg/mg TPM | 2.41 | 1.31 | 46 |
| Hydroquinone | μg/mg TPM | 1.76 | 1.06 | 40 |
| NNN | ng/mg TPM | 10.8 | 5.5 | 49 |
| NNK | ng/mg TPM | 6.5 | 3.8 | 42 |
| BaA | ng/mg TPM | 0.77 | 0.45 | 42 |
| BaP | ng/mg TPM | 0.36 | 0.23 | 36 |
| BIOLOGICAL SCREENING | | | | |
| TPM Cytotoxicity (1/EC50) | mL/mg TPM | 6.73 | 3.82 | 43 |
| TPM mutagenicity (TA98/S9) | Rev/mg TPM | 1547 | 969 | 37 |

Wherein "DWB" stands for dry weight basis; "TPM" stands for total particulate matter; and TA98 is the strain of bacteria used in the Ames test for testing mutagenicity.

All cited patents and publications referred to in this application are herein incorporated by reference in their entirety for all purposes.

What is claimed is:

1. A tobacco comprising composition comprising a natural tar diluent, wherein (a) the natural tar diluent is 2-methyldotriacontane, 2-methylhentriacontane; 2-methylheptacosane; 2-methylhexacosane; 2-methylnonacosane; 2-methyloctacosane; 2-methyltetratriacontane; 2-methyltriacontane; 2-methyltritriacontane; 3-methyldotriacontane; 3-methylhentriacontane; 3-methylheptacosane; 3-methyloctacosane; 3-3-methyltetratriacontane; 3-methyltriacontane; 3-methyltritriacontane; docosane; dotriacontane; hentriacontane; heptacosane; hexacosane; nonacosane; octacosane; pentacosane; pentatriacontane; squalene; tetracosane; tetratriacontane; or tritriacontane; or a combination thereof, or (b) the natural tar diluent is selected from the group consisting of 4-(4-tolyl)-1-butanol; eugenol methyl ether; 5-isopropyl-8-methylnona-6,8-dien-2-one; 4-methylvaleramide; phenylacetamide; 3-phenylpropionamide; nicotinamide; 6-ethyl-3-pyridine-carboxamide; (R)-cotinine; (R)-N'-alkanoylnornicotine; (R)-N-methylanabasine; (S)-N-valerylanabasine; (R)-N'-ethylnornicotine; (R)-N'-carbomethoxyanabasine; (R)-N'-carbomethoxynornicotine; 2-furylpyrazine; a butenylpyrazine; 4-(3-methyl-2-pyrazinyl)-butyl alcohol; 2-(6-methyl-2-pyrazinyl)-ethyl alcohol; 2-methyl-3-hydroxyethyl pyrazine; or a combination thereof, wherein the natural tar diluent is present in an amount of about 25 to about 75 weight percent of total tobacco tar produced from burning the tobacco comprising composition, and wherein the composition further comprises an artificial tar diluent.

2. The tobacco comprising composition of claim 1, wherein the natural tar diluent is over-expressed in a tobacco plant.

3. The tobacco comprising composition of claim 1, wherein the artificial tar diluent is glycerin, and the glycerin is present in an amount of about 5 to about 10 weight percent of total tobacco tar produced from burning the tobacco comprising composition.

4. The tobacco comprising composition of claim 1, wherein the tobacco has a reduced tobacco specific nitrosamine level, wherein the tobacco specific nitrosamine level is reduced by mechanical manipulation of the tobacco plant, chemical treatment of a tobacco plant or part thereof, and/or a genetically engineered tobacco plant with reduced tobacco specific nitrosamines.

5. The tobacco comprising composition of claim 4, wherein the reduced tobacco specific nitrosamine is N-nitrosoketone and/or nitrosonornicotine.

6. A smoking article comprising the tobacco comprising composition of claim 1.

7. The tobacco comprising composition of claim 1, wherein the natural tar diluent is present in an amount of about 40 to about 75 weight percent of total tobacco tar produced from burning the tobacco comprising composition.

8. The method of claim 1, wherein the natural tar diluent is present in an amount of about 50 to about 75 weight percent of total tobacco tar produced from burning the tobacco comprising composition.

9. A method of decreasing one or more TSNAs or tar components in a smoking article comprising:

(a) administering to a tobacco material a natural tar diluent and an artificial tar diluent;

(b) placing the tobacco material with the natural tar diluent and the artificial tar diluent in a smoking article; and (c) smoking the smoking article, wherein (a) the natural tar diluent is 2-methyldotriacontane, 2-methylhentriacontane; 2-methylheptacosane; 2-methylhexacosane; 2-methylnonacosane; 2-methyloctacosane; 2-methyltetratriacontane; 2-methyltriacontane; 2-methyltritriacontane; 3-methyldotriacontane; 3-methylhentriacontane; 3-methylheptacosane; 3-methyloctacosane; 3-3-methyltetratriacontane; 3-methyltriacontane; 3-methyltritriacontane; docosane; dotriacontane; hentriacontane; heptacosane; hexacosane; nonacosane; octacosane; pentacosane; pentatriacontane; squalene; tetracosane; tetratriacontane; or tritriacontane; or a combination thereof, or (b) the natural tar diluent is selected from the group consisting of 4-(4-tolyl)-1-butanol; eugenol methyl ether; 5-isopropyl-8-methylnona-6,8-dien-2-one; 4-methylvaleramide; phenylacetamide; 3-phenylpropionamide; nicotinamide; 6-ethyl-3-pyridine-carboxamide; (R)-cotinine; (R)-N'-alkanoylnornicotine; (R)-N-methylanabasine; (S)-N-valerylanabasine; (R)-N'-ethylnornicotine; (R)-N'-carbomethoxyanabasine; (R)-N'-carbomethoxynornicotine; 2-furylpyrazine; a butenylpyrazine; 4-(3-methyl-2-pyrazinyl)-butyl alcohol; 2-(6-methyl-2-pyrazinyl)-ethyl alcohol; 2-methyl-3-hydroxyethyl pyrazine; or a combination thereof, and wherein the natural tar diluent is present in an amount of about 25 to about 75 weight percent of total tobacco tar produced from burning the tobacco material.

10. The method of claim 9, wherein the artificial tar diluent is glycerin.

11. The method of claim 9, wherein the decreased component is a tobacco specific nitrosamine.

12. The method of claim 11, wherein the tobacco material is a tobacco selected from a group consisting of tobacco that has been mechanically treated to have reduced tobacco specific nitrosamines, a tobacco that has been chemically treated to have reduced tobacco specific nitrosamines, a tobacco genetically engineered to have reduced tobacco specific nitrosamine; and a combination thereof.

13. The method of claim 9, wherein the natural tar diluent is present in an amount of about 40 to about 75 weight percent of total tobacco tar produced from burning the tobacco comprising composition.

14. The method of claim 9, wherein the natural tar diluent is present in an amount of about 50 to about 75 weight percent of total tobacco tar produced from burning the tobacco comprising composition.

* * * * *